US007345631B2

(12) United States Patent
Kim et al.

(10) Patent No.: US 7,345,631 B2
(45) Date of Patent: Mar. 18, 2008

(54) RADIATION DEVICE FOR PLANAR INVERTED F ANTENNA

(75) Inventors: Byung Chan Kim, Daejon (KR); Juderk Park, Daejon (KR); Hyung Do Chol, Seoul (KR); Jong-Suk Chae, Daejon (KR)

(73) Assignee: Electronics and Telecommunications Research Institute, Daejon (KR)

( * ) Notice: Subject to any disclaimer, the term of this patent is extended or adjusted under 35 U.S.C. 154(b) by 0 days.

(21) Appl. No.: 10/526,078

(22) PCT Filed: Aug. 28, 2003

(86) PCT No.: PCT/KR03/01750

§ 371 (c)(1),
(2), (4) Date: Jul. 28, 2005

(87) PCT Pub. No.: WO2004/021514

PCT Pub. Date: Mar. 11, 2004

(65) Prior Publication Data

US 2006/0001573 A1 Jan. 5, 2006

(30) Foreign Application Priority Data

Aug. 28, 2002 (KR) ..... 10-2002-0051039

(51) Int. Cl.
*H01Q 1/38* (2006.01)

(52) U.S. Cl. ..... 343/700 MS; 343/829

(58) Field of Classification Search ..... 343/700 MS, 343/702, 829, 846
See application file for complete search history.

(56) References Cited

U.S. PATENT DOCUMENTS 5,926,150 A * 7/1999 McLean et al. ..... 343/846
6,501,425 B1 * 12/2002 Nagumo et al. ..... 343/700 MS

FOREIGN PATENT DOCUMENTS

| | | |
|---|---|---|
| EP | 0450881 | 3/1991 |
| EP | 1003240 | 5/2000 |
| EP | 1146589 | 10/2001 |

(Continued)

OTHER PUBLICATIONS

International Search Report from PCT/KR03/01750 dated Dec. 4, 2003.

(Continued)

*Primary Examiner*—Michael C. Wimer
(74) *Attorney, Agent, or Firm*—Lowe Hauptman Ham & Berner LLP

(57) ABSTRACT

A radiation patch having a shape of linearly-tapered rectangle for a planar inverted F antenna is disclosed. The planar inverted F antenna having a radiation patch includes: a ground unit for grounding a radiation patch; a short unit for shorting the radiation patch; a feeding unit for supplying an electric power to the radiation patch; and a radiation patch for radiating electric power from the feeding unit, wherein the radiation patch having a shape of linearly tapered rectangle and a length and width of tapered sides of radiation patch is determined according to a resonate frequency. As mentioned above, the present invention can be easier to be designed and provide wider bandwidth by providing a linearly tapered rectangle shape of radiation patch in a planar inverted F antenna.

5 Claims, 3 Drawing Sheets

FOREIGN PATENT DOCUMENTS

| | | |
|---|---|---|
| JP | 09/214244 | 8/1997 |
| JP | 10-107535 | 4/1998 |
| KR | 1020020045914 | 6/2002 |
| KR | 1020020061138 | 7/2002 |
| WO | 98/13896 | 4/1998 |

OTHER PUBLICATIONS

European Search Report from EP 03 79 1465 dated Jul. 12, 2005.

Virga et al.; "Low-Profile Enhanced-Bandwidth PIFA Antennas for Wireless Communications Packaging"; IEEE transactions On Microwave Theory And Techniques; Oct. 1997; pp. 1879-1888.

* cited by examiner

RADIATION DEVICE FOR PLANAR INVERTED F ANTENNA

CROSS REFERENCE TO RELATED APPLICATION

This application is the National Phase application of International Application No. PCT/KR2003/001750, filed Aug. 28, 2003, which designates the United States and was published in English. This application, in its entirety, is incorporated herein by reference.

TECHNICAL FIELD

The present invention relates to a radiation device for a planar inverted F antenna; and, more particularly, to the radiation patch having a shape of linearly-tapered rectangle for a planar inverted F antenna in order to provide wide bandwidth characteristic.

BACKGROUND ARTS

A planar inverted F antenna is a modified microstrip antenna having a shape of inverted F.

FIG. 1 is a diagram illustrating a conventional planar inverted F antenna in accordance with a prior art.

Referring to FIG. 1, the conventional planar inverted F antenna includes a rectangular radiation patch 101, a shorting plate 103, a feeding line 105 and a ground plane 107.

The shorting plate 103 is attached between the ground plane 107 and the rectangular radiation patch 101. The feeding line 105 supplies electric power to the rectangular radiation patch 101.

The planar inverted F antenna has been widely used in a wireless communication field since its advantages such as simple structure, easy to manufacture and low cost.

However, the conventional planar inverted F antenna has narrow frequency bandwidth such as 8%~10% frequency bandwidth of a linear antenna or dipole antenna.

For overcoming the narrow frequency bandwidth, Kathleen L. Virga and Yahya Rahmat-Smaii introduces a new technology in "Low-Profile Enhanced-Bandwidth PIFA antennas for wireless communications packaging" IEEE Transaction on Microwave Theory and Techniques, Vol, 45, No. 10, pp. 1879~1888, October 1997.

For widening the frequency bandwidth, Kathleen and Yahya implements additional patches to an antenna or two patches connected by tuning diode as a radiation device. As a result, a frequency bandwidth is getting wider, e.g., 14% of bandwidth is increased than the linear antenna or dipole antenna.

However, the antenna introduced by Kathleen and Yahya is complicated and a manufacturing cost is increased.

Beside of the above mentioned antenna, other techniques for overcoming narrow bandwidth of the conventional planar inverted F antenna have been disposed. As mentioned above, in the prior art, wider bandwidth is archived by punching the patch with a slot, providing a double resonating method, attaching a resistor in the shorting plate or providing a multiple structure by loading high dielectric in the patch and ground plate and in between patches. AS a result, the bandwidth of the conventional planar inverted F antenna has become widened, however, it is getting more complicated and for designing the conventional planar inverted F antenna.

In a meantime, an external shape of the radiation patch in accordance with a prior art is limited as a shape of rectangle therefore, it limits to design of structure design of antenna.

DISCLOSURE OF THE INVENTION

It is, therefore, an object of the present invention to provide a planar inverted F antenna for widening frequency bandwidth and obtaining flexibility of antenna design by providing a linearly tapered rectangular shape of radiation patch.

In accordance with an aspect of the present invention, there is provided a radiation patch equipped in a planar inverted F antenna for radiating applied signals, wherein the radiation patch having a shape of linearly tapered rectangle and a length and width of tapered sides of radiation patch is determined according to a resonate frequency.

In accordance with another aspect of the present invention, there is also provided a planar inverted F antenna having a radiation patch, wherein the radiation patch having a shape of linearly tapered rectangle and a length and width of tapered sides of radiation patch is determined according to a resonate frequency.

In accordance with still another aspect of the present invention a planar inverted F antenna having a radiation patch, including: a ground unit for grounding a radiation patch; a short unit for shorting the radiation patch; a feeding unit for supplying an electric power to the radiation patch; and a radiation patch for radiating electric power from the feeding unit, wherein the radiation patch having a shape of linearly tapered rectangle and a length and width of tapered sides of radiation patch is determined according to a resonate frequency.

BRIEF DESCRIPTION OF THE DRAWING(S)

The above and other objects and features of the present invention will become apparent from the following description of the preferred embodiments given in conjunction with the accompanying drawings, in which.

MODES FOR CARRYING OUT THE INVENTION

Other objects and aspects of the invention will become apparent from the following description of the embodiments with reference to the accompanying drawings, which is set forth hereinafter.

Figure 1:
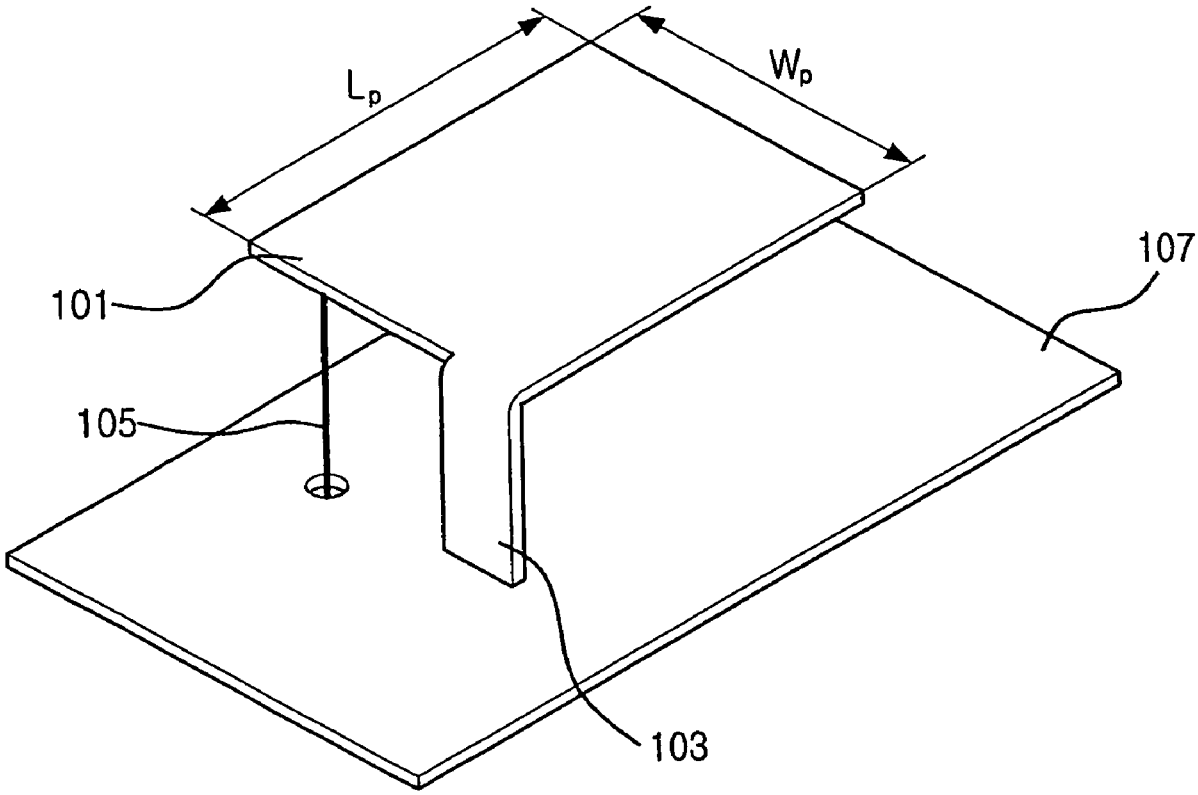
FIG. 1 is a diagram illustrating a conventional planar inverted F antenna in accordance with a prior art.
Figure 2:
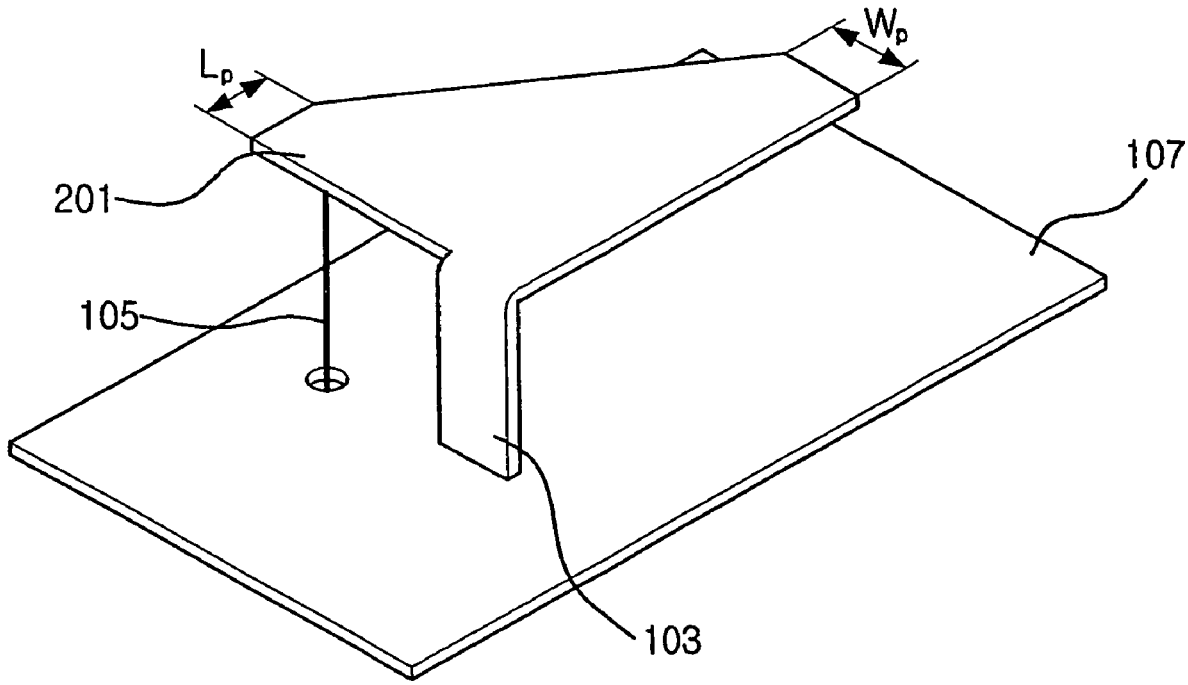
FIG. 2 is a diagram illustrating a planar inverted F antenna in accordance with a preferred embodiment of the present invention.

FIG. 2 is a diagram illustrating a planar inverted F antenna in accordance with a preferred embodiment of the present invention.

Referring to FIG. 2, the planar inverted F antenna includes a radiation patch 201, a shorting plate 103, a feeding line 105 and a ground plate 107.

The shorting plate 103 is equipped in between the ground plate and the radiation patch 201. One side of the shorting plate 13 is coupled to the radiation patch 101 and other side of the shorting plate 130 is coupled to the ground plate. The shorting plate has a function to short the radiation patch 201.

The feeding wire 105 connected to the radiation patch 201 through the ground plate 107 has a function to supply electric power to the radiation patch 201.

The radiation patch 201 of the present invention has an asymmetrical shape of linearly tapered rectangle. If length of linearly tapered rectangle shape of radiation patch is $L_p$ and width of linearly tapered rectangle shape of radiation patch is $W_p$, then a characteristic of bandwidth of the linearly tapered rectangle shape of radiation patch 201 is varied according to a ratio of length $L_p$ and width $W_p$. That is, by controlling the ratio of $L_p$ and $W_p$ of the linearly tapered rectangle shape of radiation patch 201, the bandwidth of the radiation patch can be widened.

Figure 3:
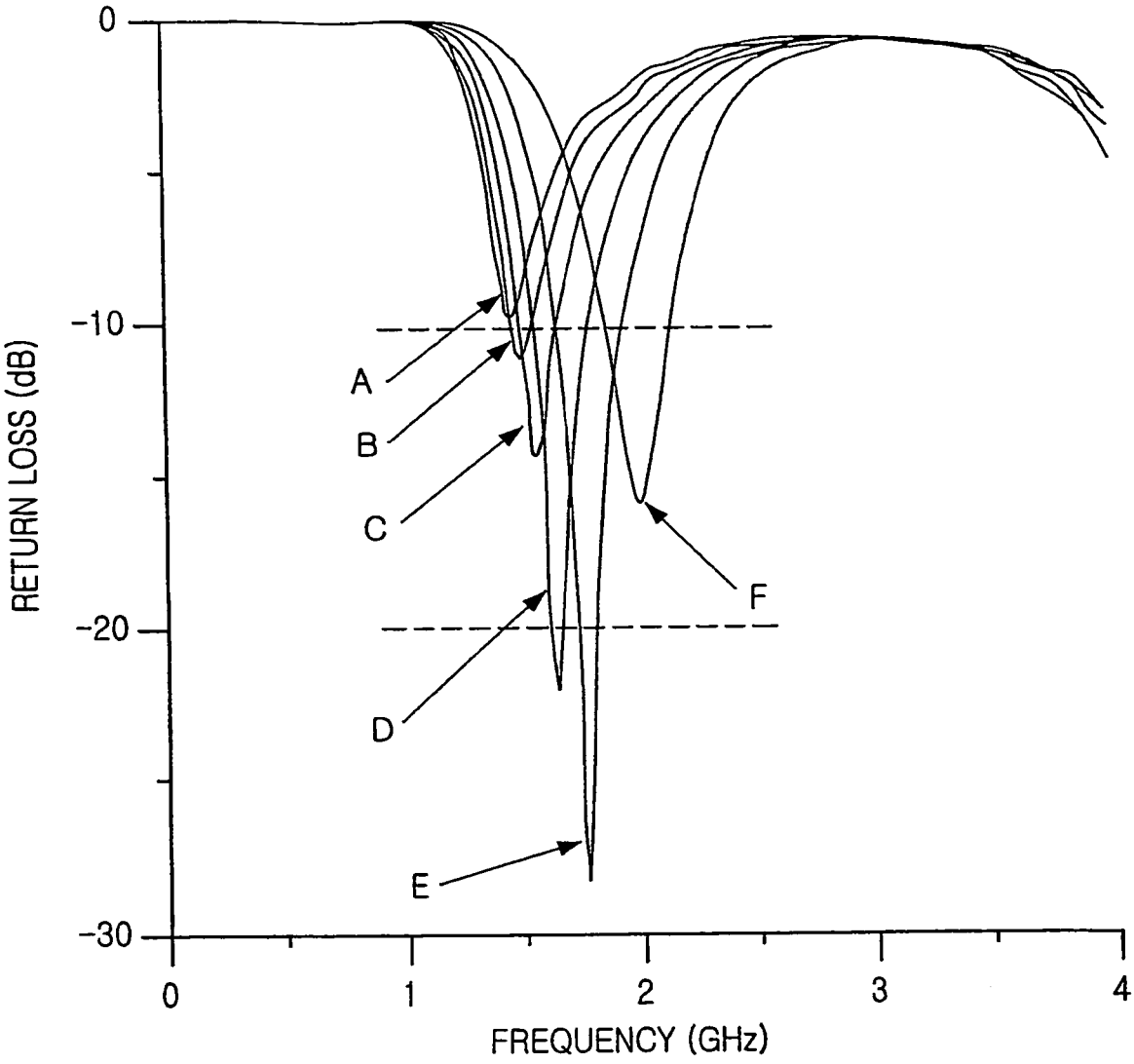
FIG. 3 is a graph showing variations of frequency bandwidths according to ratios of $L_p$ and $W_p$ in accordance with a preferred embodiment of the present invention.

FIG. 3 is a graph showing variations of frequency bandwidths according to ratios of $L_p$ and $W_p$ in accordance with a preferred embodiment of the present invention.

For obtaining data of graph in FIG. 3, a simulation is performed by using an antenna having a ground plate of length 70 mm, width 30 mm and height 6 mm. The graph is drawn by MicroWaveStudio (CST corp.) which is 3D full-wave simulator.

Referring to FIG. 3, there are 6 difference curves A to F representing frequency bandwidths of corresponding ratios of $L_p$ and $W_p$. Each ratio of corresponding curves A to F is shown in below table. There are 5 mm differences of $L_p$ and $W_p$ between ratios shown in table.

TABLE 1

| Curve | $L_p$ [mm] | $W_p$ [mm] |
|---|---|---|
| A | 35 | 25 |
| B | 30 | 20 |
| C | 25 | 15 |
| D | 20 | 10 |
| E | 15 | 5 |
| F | 10 | 0 |

As shown in FIG. 3, −20 dB of reflection coefficient is used as a start point of operation of the antenna and −10 dB is used as a bandwidth.

In case of curve E, which shows frequency bandwidth in a ratio of 15 mm as $L_p$ and 5 mm as $W_p$, an upward frequency is 1.935 GHz and a downward frequency is 1.643 GHz at 1.762 GHz of resonate frequency. It is 16% bandwidth and it is expanded comparing to the conventional planar inverted F antenna.

As mentioned above, the present invention can be easier to be designed by providing a linearly tapered rectangle shape of radiation patch in a planar inverted F antenna.

Also, the present invention can provide wider bandwidth comparing to the prior art by providing a linearly tapered rectangle shape of radiation patch in a planar inverted F antenna.

Furthermore, the present invention can be implemented in various application fields by providing a linearly tapered rectangle shape of radiation patch in a planar inverted F antenna.

While the present invention has been described with respect to certain preferred embodiments, it will be apparent to those skilled in the art that various changes and modifications may be made without departing from the scope of the invention as defined in the following claims.

What is claimed is:

1. A radiation patch equipped in a planar inverted F antenna for radiating applied signals, wherein the radiation patch defines a plan view rectangular shape absent a right-triangle corner portion that defines a cutting edge bisecting first and second perendicular sides of the rectangular shape, and wherein a length of the first side bisected by the cutting edge and a width of the second side bisected by the cutting edge are determined according to a desired resonant frequency of the radiation patch.

2. A planar inverted F antenna having a radiation patch, comprising:

a ground means for grounding a radiation patch;

a short means for shorting the radiation patch;

a feeding means for supplying an electric power to the radiation patch; and a radiation patch for radiating electric power from the feeding means, wherein the radiation patch has a rectangular shape having a triangle-shaped cutting edge and a length and width of tapered sides of the radiation patch is determined according to a resonant frequency.

3. The planar inverted F antenna having a radiation patch as recited in claim 2, wherein a width of the short means is varied according to a desired resonant frequency.

4. The planar inverted F antenna having a radiation patch as recited in claim 2, wherein a location of the feeding means is varied according to the desired resonated frequency.

5. A planar inverted F antenna having a radiation patch, comprising:

a ground means for grounding a radiation patch;

a short means for shorting the radiation patch;

a feeding means for supplying an electric power to the radiation patch; and a radiation patch for radiating electric power from the feeding means, wherein the radiation patch defines a plan view rectangular shape absent a right-triangle corner portion that defines a cutting edge bisecting first and second perpendicular sides of the rectangular shape, and wherein a length of the first side bisected by the cutting edge and a width of the second side bisected by the cutting edge are determined according to a desired resonant frequency of the radiation patch.

* * * * *